United States Patent [19]

Cox

[11] Patent Number: 4,988,917

[45] Date of Patent: Jan. 29, 1991

[54] HOOKED ELECTRODE FOR ARC LAMP

[75] Inventor: David A. Cox, Lexington, Ky.

[73] Assignee: GTE Products Corporation, Danvers, Mass.

[21] Appl. No.: 285,903

[22] Filed: Dec. 16, 1988

[51] Int. Cl.[5] ..... H01J 61/04

[52] U.S. Cl. ..... 313/631; 313/621; 313/622

[58] Field of Search ..... 313/620, 621, 631, 574, 313/326, 357

[56] References Cited

U.S. PATENT DOCUMENTS 865,367 9/1907 Edison ..... 313/631 X 4,320,322 3/1982 Rothwell, Jr. et al. ..... 313/621

4,782,266 11/1988 Heider et al. ..... 313/631

*Primary Examiner*—Kenneth Wieder

*Attorney, Agent, or Firm*—William E. Meyer

[57] ABSTRACT

A hooked arc discharge lamp electrode may be formed with electrodes slanting towards each other and towards the electrode roots. The hooking back of the electrode tips forms a gap between the electrode tip and the electrode shaft that prevents the arc from wandering across. The arc is then confined to a small area from the electrode tip area on the side away from the gap. The arc is prevented from wandering down the electrode shafts away from the optically ideal location, and to a potentially destructive position adjacent the envelope wall.

28 Claims, 5 Drawing Sheets

HOOKED ELECTRODE FOR ARC LAMP

1. TECHNICAL FIELD

The invention relates to electric lamps and particularly to arc discharge electric lamps. More particularly the invention is concerned with single ended arc discharge electric lamps with side by side electrodes shaped to prevent arc wandering.

2. BACKGROUND ART

Arc discharge lamps operate by jumping an electric arc between two displaced electrodes. The electric arc excites the atoms of a gas along the arc path to high energy states resulting in light and heat. Arcing ideally occurs directly between the electrode tips, which is generally accomplished by making the gap between the electrode tips the smallest distance between the electrodes.

Due to heating of the electrode shaft, the gas surrounding the shaft, or to surface conductivity, arcing may occur away from the ideal tip of the electrode. The electrode material adjacent the arc generation point may become hot and electron emissive. The adjacent area may then act as an additional source for the arc generation and become hotter. In time the new source point may become the sole arc source point. The process may continue with the arc wandering along the length of the electrode, even when the distance between the two arc points is no longer minimal. The arc may then moved from the optically ideal position, thereby upsetting the optical design. In the worst case, the wandering arc may settle near the envelope material. The envelope may then be heated beyond the material tolerance, resulting in lamp failure.

A double ended arc discharge lamp design uses collinear, but separated electrodes. The input leads are then substantially separated to strongly control the arc position, but making convenient bases difficult to design. Alternatively, the electrodes may be positioned generally side by side for a single ended design thereby allowing a more conventional base, and potential arc wandering.

In most single ended, side by side electrode designs, the active area of the electrode is the tip of a shaft where emission and collection of electrons occurs. It is known in the art to bend or angle the shafts towards one another thereby making the tip to tip distance the smallest separation between the electrodes. Several forms of side by side electrodes exist, and example electrodes may be seen in U.S. Pat. Nos. 2,687,489; 2,876,427; 3,170,081; 3,405,303; 3,849,690; and 4,275,329.

The electrode shafts may be parallel, ending with blunt or formed electrode tips. Unfortunately, the arc may wander along the length of the parallel electrode shafts. The electrode shafts may angle or curve towards one another ending with the electrode tips pointing one to the other. Angling or curving the shafts requires sufficient envelope volume to contain the required tip separation and the angled shafts. Arc wandering may still occur along the portions of the shaft adjacent and continuous with the electrode tip. The electrode shafts may be parallel and then bend at right angles toward each other so the electrode tips point one to the other, forming an L shaped electrode. The whole foot of an L shaped electrode may become emissive, with arc wandering still occurring along the parallel shaft sections. There is then a need to provide an electrode form useful in arc discharge lamps with side by side electrodes that prevents arc wandering.

DISCLOSURE OF THE INVENTION

An electrode to prevent arc wandering in an arc discharge lamp having generally side by side electrodes may be formed as a shaft portion projecting in a first direction, leading to a portion hooking back with respect to the first direction and offset from the shaft portion, and including on the hooking back portion an electrode tip positioned for arc discharge in a direction generally transverse to the first direction thereby forming a gap between the shaft portion, and tip portion in the discharge direction.

BEST MODE FOR CARRYING OUT THE INVENTION

Figure 1:
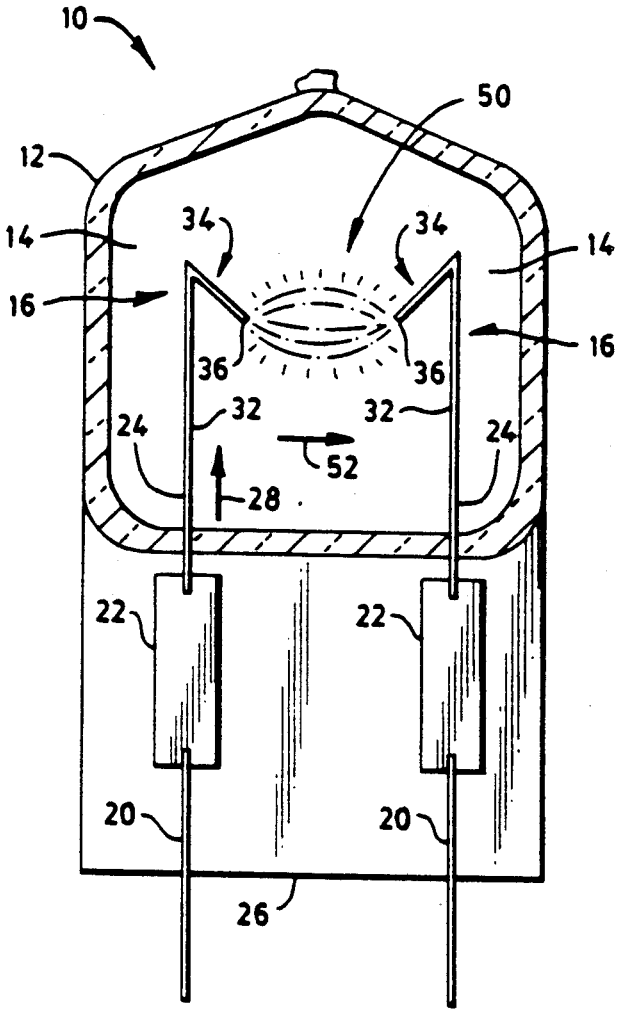
FIG. 1 shows in cross-section a preferred embodiment of an arc lamp with hooked electrodes.

FIG. 1 shows in cross-section a preferred embodiment of a continuous arc discharge lamp 10 with hooked electrodes. The lamp 10 includes an envelope 12 of light transmissive material defining an enclosed volume 14. Positioned in the volume 14 are two symmetric, generally side by side electrodes 16 each with a shaft portion 24, and a hooked portion 34 bending back to a tip 36. Electrical connections from the exterior of the envelope 12 to the electrodes 16 cause a voltage difference between the tips 36, and thereby power a continuous electric arc discharge 50. By way of example the arc discharge lamp 10 is shown as a high voltage discharge lamp, although the lamp may be of any other suitable cross section configuration.

The envelope 12 for arc discharge lamps may be formed from radiant energy transmissive materials such as fused silica, glass, alumina and others known in the art. These materials are melt formable by application of gas pressure, or mechanical force. Typically, a general form, such as a tube, is made, and subsequently closed off by heating the material and either tipping off or press sealing the open areas to enclose the envelope volume 14. The typical volume 14 may range from 0.1 ml to 1.0 liter, but larger and smaller volumes are possible. The actual volume chosen depends on the light output sought from the lamp, the electrode size and separation, and the ability of the envelope material to withstand the resulting heat loading. The present design is felt to be generally useful, but particularly so where the lamp volume 14 is small thereby restricting electrode positioning.

The enclosed volume 14 of an arc discharge tube is filled with a gas chosen for its particular discharge reaction to an electric arc. Examples of such gas fills are inert gases such as argon, xenon or neon. Additions of excitable materials such as mercury and iodides of sodium, scandium, tin and others as are known in the art are included in the fill gas to enhance light generation. The particular gas fill is not felt to be significant with the respect to applicant's teaching.

Electrical connections are made between the exterior of the envelope 12 and the electrodes 16. A common method of connection may be made by connecting an outer lead 20 to a metal foil 22, commonly molybdenum foil, which is in turn connected to the root end of an electrode shaft 24. The outer lead to foil and foil to electrode shaft connections are commonly captured in the envelope material during press sealing. The electrode shafts 24 are positioned, so the nearest points are the tips 36. The surrounding envelope 12 is heated to a softened state with the outer leads 20, foils 22 and root ends of shafts 24 positioned in the encompassing softened zone of the envelope. Clamps press the softened envelope material from opposite sides of the connection elements. The softened envelope material seals around the connection elements forming the press seal 26. Exposed at one end for electrical connection, but extending into and captured in the envelope 12 at an opposite end are exterior leads 20. The foils 22 are completely entrained in the envelope material to expand and contract with the envelope and thereby not break the gas seal made by the envelope material. The seal partially captures and holds the roots of the shafts 24 in the interior envelope surface material, with the shafts 24 projecting into the enclosed volume 14 in a side by side fashion, defining a shaft direction 28.

In the preferred embodiment, the shaft 24, has the form of a metal rod at one end with a diameter 30, and extends into the enclosed volume 14 for at least several shaft diameters 30. Along the length of each shaft 24 opposite other shaft is an inside surface 32 along which improper arc wandering is to be prevented. The shaft 24 has sufficient size and conductivity to rigidly support the tips 36 without sagging or deforming due to heat. Otherwise, the shaft 24 should have a minimized shaft diameter 30 to limit heat conduction from the arc heated tips 36. It is felt to be within the skill in the art to determine the shaft 24 length and diameter 30 given the resistance of the chosen material and the lamp operation amperage.

Figure 2:
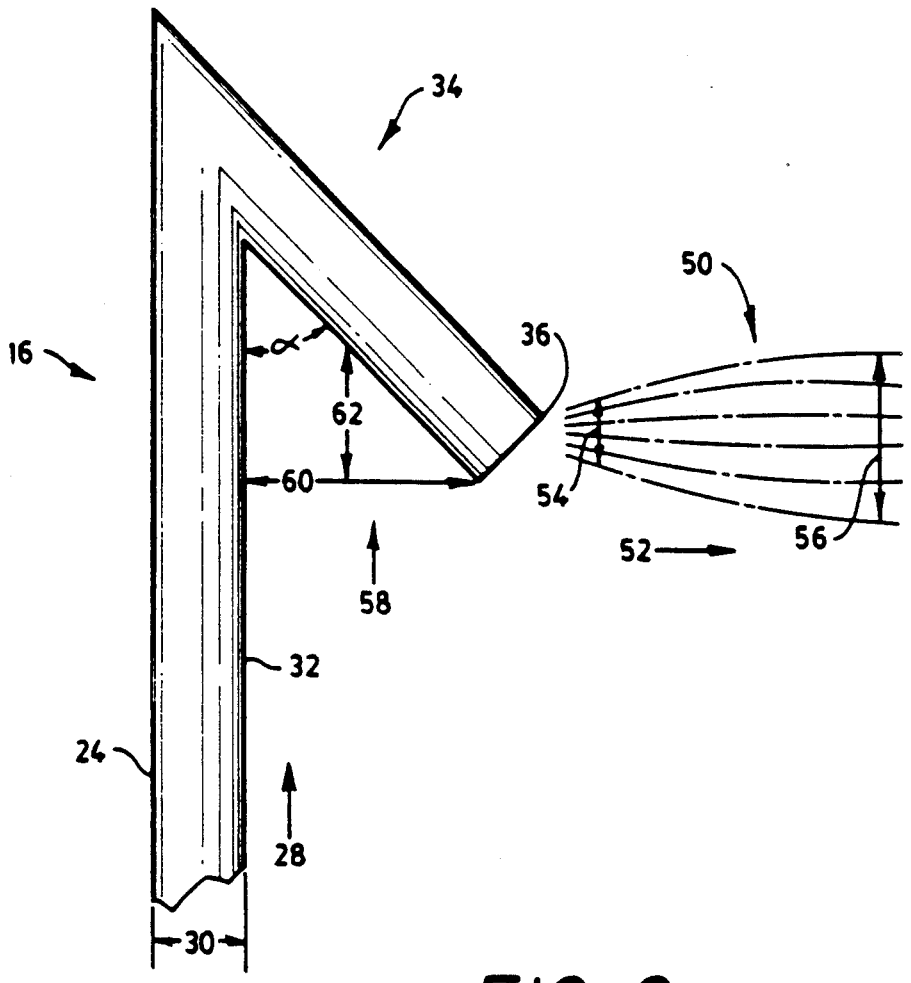
FIG. 2 shows a detailed view of a preferred embodiment of the hooked electrode with a straight bend hook.
Figure 3:
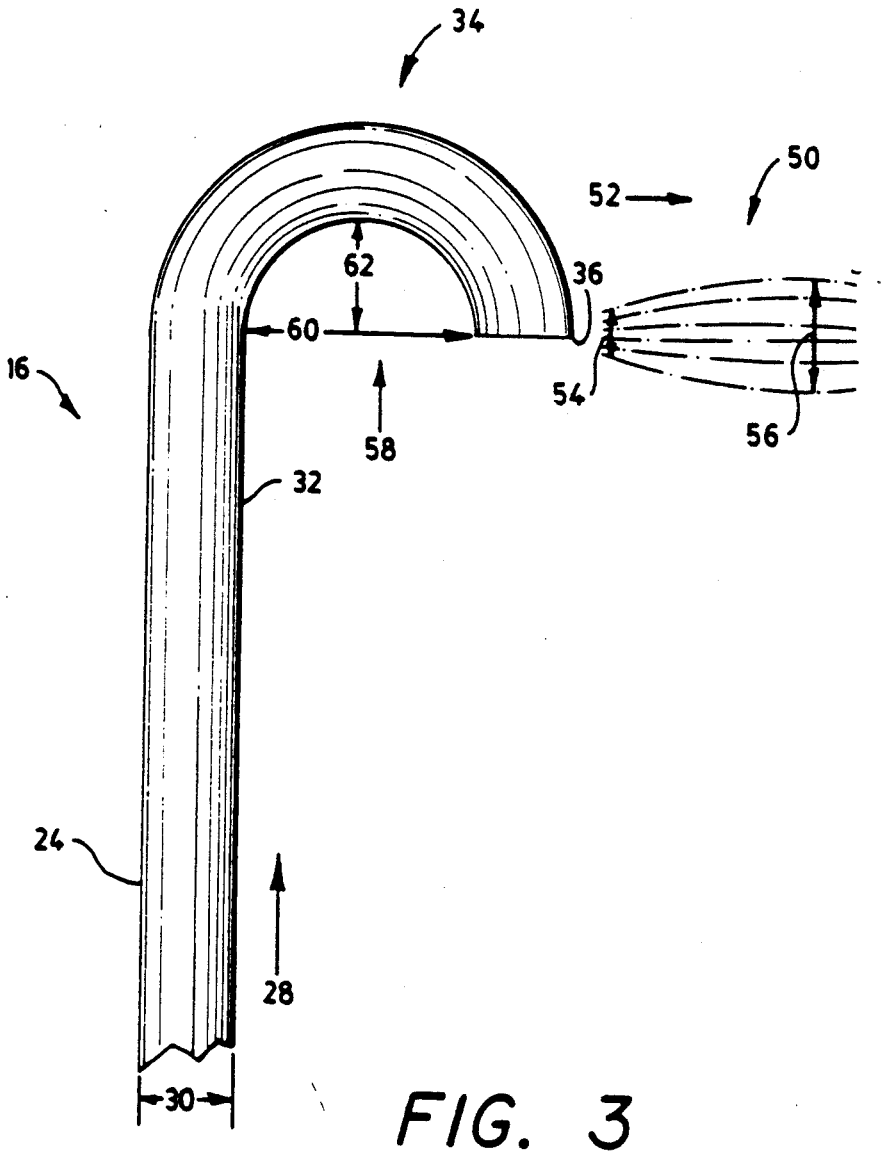
FIG. 3 shows a detailed view of an alternative embodiment of the hooked electrode with a circular section hook.
Figure 4A:
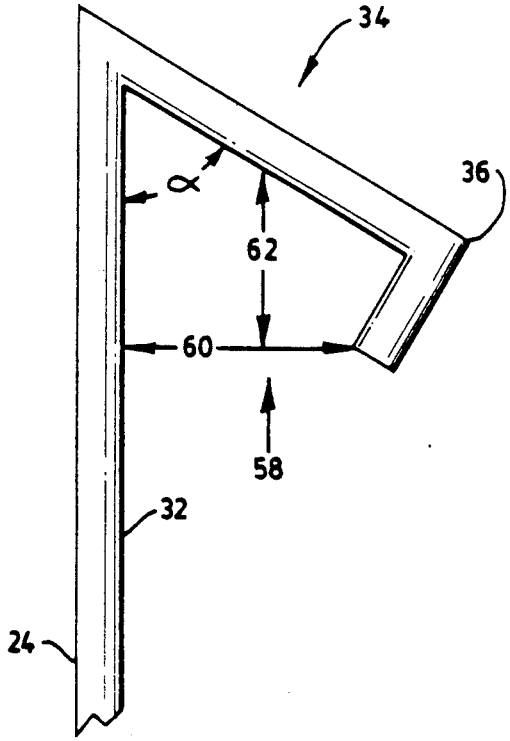
FIGS. 4*a*–4*d* show alternative hook shapes for electrode ends.
Figure 4B:
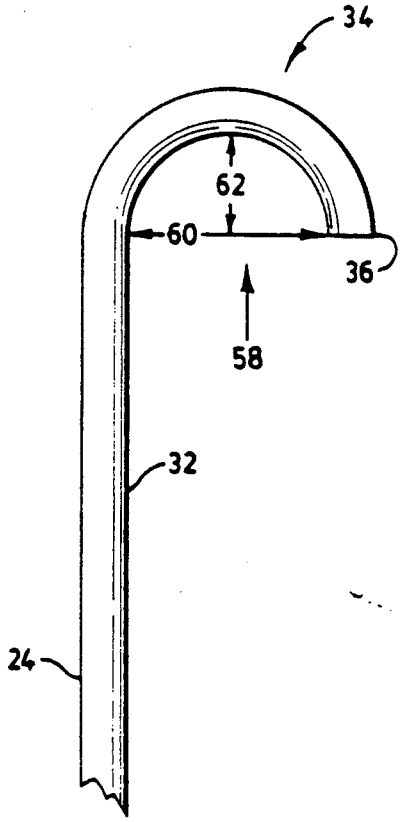
Figure 4C:
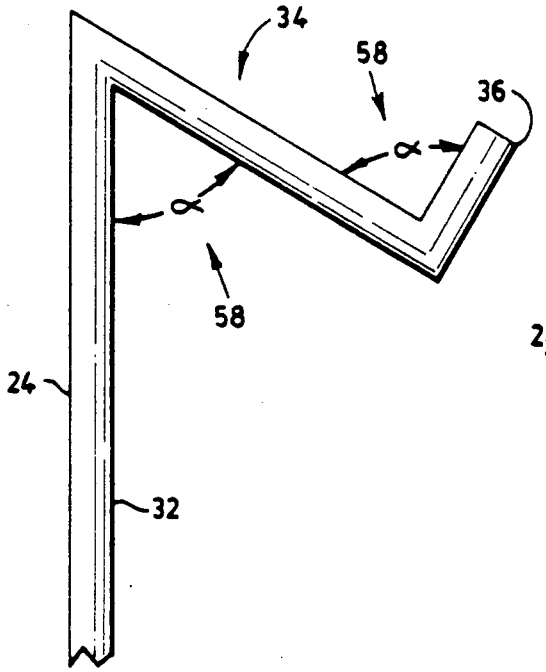
Figure 4D:
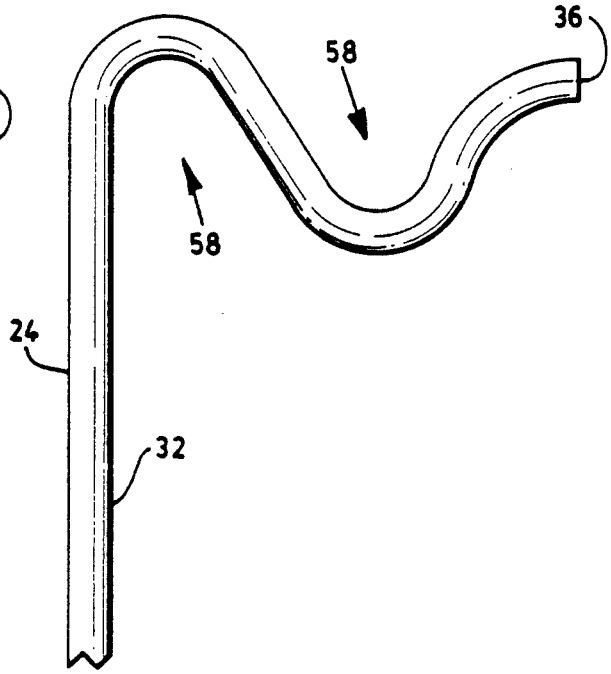

FIG. 2 shows a detailed view of a preferred embodiment of the hooked electrode with a straight bend hook, and FIG. 3 shows a detailed view of an alternative embodiment of the hooked electrode with a circular section hook. In the preferred embodiment, formed on the shaft 24 on the end away from the press seal 26 is a hooked portion 34 designed to position a tip 36 to be the nearest point of each electrode to the opposite electrode. At least one electrode extends in a direction with one component opposite the shaft direction 28, and another component roughly transverse to the shaft direction 28 towards the opposite electrode. The end of the shaft 24 then hooks back towards the length of the shaft 24 on the side closest the other electrode, but offset from the inside surface 32. A projection towards the shaft 24, in a direction transverse to the shaft direction 28 of the tip 36, then overlaps the shaft 24 or hooked portion 34. A portion of the electrode between the inside surface 32 and the tip 36 is concave, so a crossing line must pass through open space. The hooked portion 34 may be a straight bend, FIG. 3*a*. The shaft 24 and hooked portion 34 may then take the form of an angle. The internal angle alpha should be less than 90° to form a gap 58, and preferrably about 45°. Other alternative bends may be made. For example, the hooked portion 34 may include an elbow bend, FIG. 4*a*, a spiral arc, FIG. 4*b*, or similar shape. FIG. 4*c* shows a straight bend, double hooked structure where a second hooked portion follows the first, bending back in the shaft direction to overlap the first hooked portion thereby forming a second gap. FIG. 4*d* shows a similar curvilinear double hooked electrode having two gap portions.

Figure 5A:
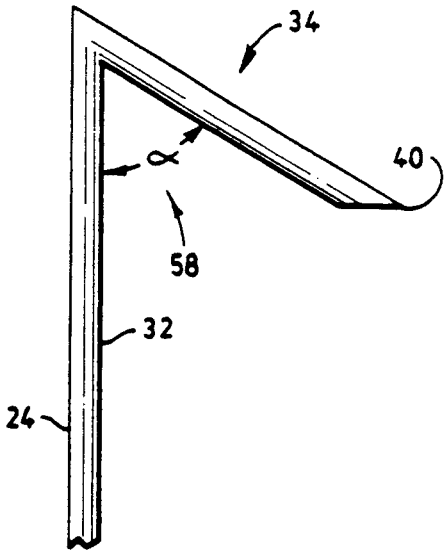
FIGS. 5*a*–5*d* show alternative tip shapes for hooked electrode ends.
Figure 5B:
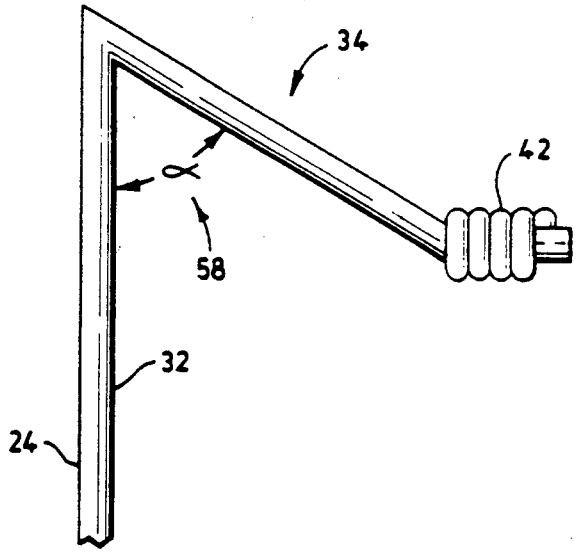
Figure 5C:
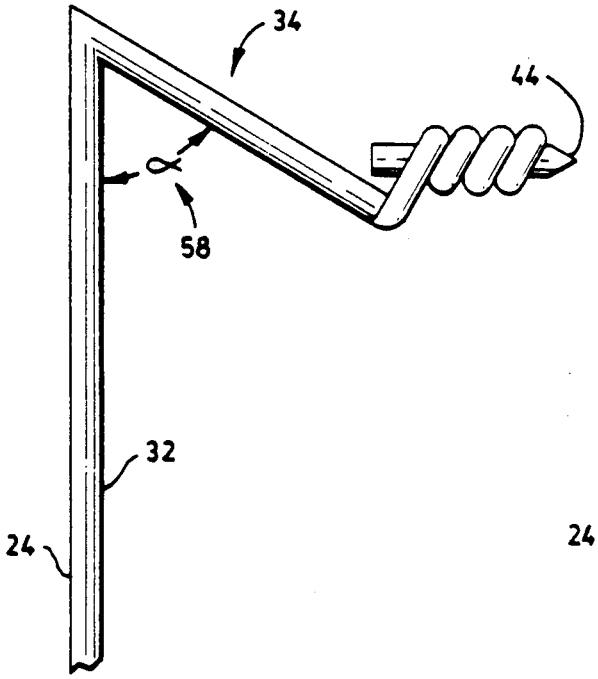
Figure 5D:
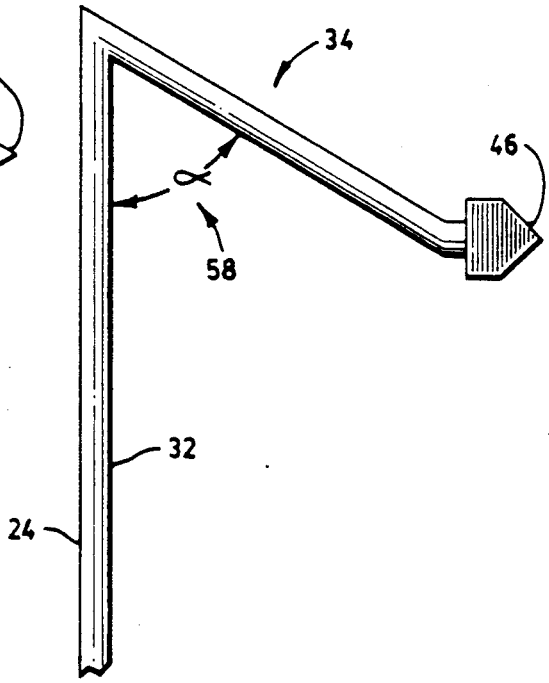

Along the length of the hooked back portion 34 is an electrode tip 36. The tip 36 needs to be electrically conductive and electron emissive at elevated temperature, and generally should withstand the temperature of operation without deforming or eroding. Electrode tip 36 geometry is generally felt to be important to the operation of an arc discharge lamp. For example, forming a point where the arc starts, improves the starting and restarting characteristics of the lamp. In particular, it is useful to form a sharp point as the nearest point to the other electrode. A sharp tip 36 provides a high current density at the tip end. The high current density results in a greater charge differential across the tip to tip gap. The high charge differential in turn aids in starting, and in maintaining an arc discharge 50 between the electrode tips 36. In the case of an alternating current lamp, high current density resulting from a sharp tip 36 helps the half cycle restrike of the lamp. In the preferred embodiment, the tip 36 is formed to have a total angle of about 45°. It is felt that a total angle of from about 20° to about 70° may be useful. Too small an angle limits heat conduction from the tip 36, and therefore encourages tip 36 melting and erosion. Too broad an angle limits the starting and restarting advantages of the pointed tip 36. One of the advantages of the the present design is the hooked portion 34 need not interfere with a specially formed tip 36. In particular, the tip 36 may be pointed 40 as shown in FIG. 5*a*, or alternatively a coil supporting tip 42 FIG. 5*b*, a coil supporting an insertable pointed tip 44, FIG. 5*c*, a cone tip 46, FIG. 5*d*, or similar tip structure as known in the art.

Providing sufficient voltage across the exterior leads 20, encourages arc discharge between the tips 36 to occur. At a sufficiently high voltage and current, electricity flows across the gap between the tips 36 resulting in an arc discharge 50 along an arc direction 52 generally transverse to the shaft direction 28. Adjacent the electrode tip 36, the arc discharge 50 has a base diameter 54, and midway between the electrodes the arc has a midpoint diameter 56.

Simultaneously, as the hooked portion 34 points the tip 36 towards the opposite electrode, formed between the inside surfaces 32 and the active tip 36 is a discontinuity or gap 58. The distance from the shaft 24 to the nearest portion in the area of the tip 36 is the cross gap distance 60. The distance from the hooked portion 34, transverse to and extending to the midpoint of the line of the cross gap distance 60 is the transverse gap distance 62. In one form the electrode may then have a J or fishhook shape with the hook opening being the cross gap distance 60, and the depth of the hook being the transverse gap distance 62.

To inhibit the arc discharge 50 from wandering along the inside surfaces 32, the gap 58 should have sufficient cross gap distance 60 and transverse gap distance 62. Any gap 58 is felt to be useful, but the preferred gap 58 has a gap crossing distance 60 greater than the arc diameter, determined by the maximum lamp voltage, and lamp pressure. The preferred gap 58 also has a transverse gap distance 62 greater than the arc diameter. The gap 58 is then intermediate the electrode shaft 24 and the electrode tip 36 on the inside surfaces 32. The shaft 24 in the area of the inside surface 32 is substantially insulated from arc over, since the gap 58 is a gas filled volume.

A large, hot active surface area is desirable, and the larger the surface area, the greater the area for collection of electrons and charged molecules. The hooked portion 34 may then usefully act as a secondary emitter and collector in the arc discharge 50 generation. With the next most likely area to emit electrons running up the length of the hooked portion 34 away from the shaft 24, the arc discharge 50, if it wanders, is confined to the hooked portion 34 away from the lamp press seal 26. For the arc discharge 50 to wander down the shaft 24, the arc discharge 50 must either wander up the hooked portion 34 to the electrode top and then down the shaft 24 or jump discontinuously across the insulating gap 58. The shaft portion 24 opposite the tip 36 across the gap 58 is less likely to be emissive than other hotter areas adjacent the tip 36. The preferred route for wandering, if any, is then along the facing side of hooked portion 34, away from the gap 58, and away from the shaft 24. The arc discharge 50 is then most favorably positioned at the electrode tip 36, and should the arc wander, the wandering is confined to the limited zone between the tip 36 and the hooked portion 34 away from the body of the shaft.

In a working example of an arc discharge lamp with an improved electrode tip, some of the dimensions were approximately as follows: The envelope was about 7.62 mm (0.3 inch) in outside diameter, and enclosed a volume of 0.25 ml. Tungsten electrodes about 10.16 mm (0.4 inch) long extended about 4.31 mm (0.17 inch) into the enclosed volume. The distance across the internal volume from the electrode root to the tip off was about 8.89 mm (0.35 inch). The electrodes were separated, center to center, by about 3.5 mm (0.13 inch). The electrode ends were bent over at 135° forming a hooked back section 1.25 mm long (0.05 inch). The cross gap distance was approximately 1.5 mm (0.06 inch). The root to root separation between the electrodes was about 35 mm (1.37 inch). The support diameter was 0.5 mm (0.02 inch), extending for a distance of 10.2 mm (0.4 inch). The disclosed operating conditions, dimensions, configurations and embodiments are as examples only, and other suitable configurations and relations may be used to implement the invention. Although the preferred embodiment has been presented in the form of bent wire or ribbon, it is understood that molded, cast, stamped, or similarly formed conductors with a concave gap intermediate the base and the support for the emissive tip are functionally equivalent.

While there have been shown and described what are at present considered to be the preferred embodiments of the invention, it will be apparent to those skilled in the art that various changes and modifications can be made herein without departing from the scope of the invention defined by the appended claims.

What is claimed is:

1. An electrode for use in an arc discharge lamp with side by side first and second electrodes, at least a first of the electrodes comprising: a shaft portion projecting in a first direction, leading to a portion hooking back with respect to the first direction on a side adjacent the second electrode and offset from the shaft portion, thereby defining a cross gap between the shaft and the hooking back portion, and a transverse gap between a midpoint of the cross gap and extending perpendicular to the cross gap to the hooking back portion, and including on the hooking back portion an electrode tip positioned for arc discharge in a direction generally transverse to the first direction thereby forming a gap between the shaft portion, and the tip portion in the discharge direction.

2. The electrode apparatus in claim 1, wherein the cross gap distance is greater than the diameter of the shaft.

3. The electrode apparatus in claim 1, wherein the transverse gap distance is greater than the diameter of the shaft.

4. The electrode apparatus in claim 1, wherein the cross gap distance is greater than the base width of the arc discharge.

5. The electrode apparatus in claim 1, wherein the cross gap distance is greater than the midpoint width of the arc discharge.

6. The electrode apparatus in claim 1, wherein the electrode includes a formed tip.

7. The electrode apparatus in claim 6, wherein the formed tip has a pointed end.

8. The electrode apparatus in claim 7, wherein the pointed tip has an angle of about 45°.

9. The electrode apparatus in claim 1, wherein the hooked portion forms an internal angle of less than 90° with the shaft.

10. The electrode apparatus in claim 9, wherein the internal angle is approximately 45°.

11. The electrode apparatus in claim 7, wherein the hooked portion leading to the tip, further includes an elbow portion extending after the tip, and bending towards the shaft to form the gap between the shaft and hook portion.

12. The electrode apparatus in claim 1, wherein the hooked portion is circular section.

13. The electrode apparatus in claim 1, wherein the hooked portion includes a section of an expanding spiral.

14. The electrode apparatus in claim 1, wherein the hooked portion after first hooking back opposite the shaft direction, then hooks in the reverse direction to extend farther from the shaft with one component in the shaft direction and a second component transverse to and away from the shaft direction to overlap at least a portion of the first hook portion and form a second gap intermediate the tip and the first hook portion.

15. An arc discharge lamp with an improved electrode comprising:

(a) an envelope formed of a radiant energy transmissive material defining by an interior surface enclosing a volume with an included fill gas, (b) two arc discharge electrodes emerging from the interior surface in a generally side by side relation, at least one of which electrodes includes a shaft portion projecting into the enclosed volume in a first direction, and a hooking back portion, on a side opposite the second electrode, extending in a direction with one component toward the second electrode, thereby defining a cross gap between the shaft and the hooking back portion, and a second component transverse the first direction, thereby defining a transverse gap between a midpoint of the cross gap and extending perpendicular to the cross gap to the hooking back portion, and including on the hooking back portion an electrode tip positioned for arc discharge in a direction generally transverse to the first direction, thereby forming a gap between the shaft portion, and the hooking back portion, and (c) two electrode connections leading from the exterior of the envelope to electrically join the electrodes.

16. The lamp apparatus in claim 15, wherein the cross gap distance is greater than the diameter of the shaft.

17. The lamp apparatus in claim 15, wherein the transverse gap distance is greater than the diameter of the shaft.

18. The lamp apparatus in claim 15, wherein the cross gap distance is greater than the base width of the arc discharge.

19. The lamp apparatus in claim 15, wherein the cross gap distance is greater than the midpoint width of the arc discharge.

20. The lamp apparatus in claim 15, wherein the electrode includes a formed tip.

21. The lamp apparatus in claim 20, wherein the formed tip has a pointed end.

22. The lamp apparatus in claim 21, wherein the pointed tip has an angle of about 45°.

23. The lamp apparatus in claim 15, wherein the hooked portion forms an internal angle of less than 90° with the shaft.

24. The lamp apparatus in claim 23, wherein the internal angle is approximately 45°.

25. The lamp apparatus in claim 15, wherein the hooked portion leading to the tip, further includes an elbow portion extending after the tip, and bending towards the shaft to form the gap between the shaft and hook portion.

26. The lamp apparatus in claim 15, wherein the hooked portion is circular section.

27. The lamp apparatus in claim 15, wherein the hooked portion includes a section of an expanding spiral.

28. An arc discharge lamp with an improved electrode comprising:

(a) an envelope formed of a radiant energy transmissive material defining by an interior surface enclosing a volume with an included fill gas, (b) two arc discharge electrodes emerging from the interior surface in a generally side by side relation, at least one of which electrodes includes a shaft portion projecting into the enclosed volume in a first direction, and a hooking back portion, on a side opposite the second electrode, extending in a second direction to form an internal angle of approximately 45° to the first direction and including on the hooking back portion an electrode tip positioned for arc discharge in a direction generally transverse to the first direction, thereby forming a gap between the shaft portion, and the hooking back portion, and (c) two electrode connections leading from the exterior of the envelope to electrically join the electrodes.

* * * * *